US005474232A

United States Patent [19]

Ljungström et al.

[11] Patent Number: 5,474,232

[45] Date of Patent: Dec. 12, 1995

[54] GABLE TOP CARTON AND CARTON BLANK WITH CURVED SIDE CREASES

[76] Inventors: Tommy B. G. Ljungström, 532 Cherbourg Ct. South, Buffalo Grove, Ill. 60089; David R. Anchor, 407 S. Sunnyside, Itasca, Ill. 60143

[21] Appl. No.: 238,923

[22] Filed: May 6, 1994

[51] Int. Cl.[6] ..... B65D 5/08

[52] U.S. Cl. ..... 229/137; 229/184; 229/214; 229/930

[58] Field of Search ..... 229/137, 138, 229/125.42, 213, 214, 184, 930, 183

[56] References Cited

U.S. PATENT DOCUMENTS

| | | | |
|---|---|---|---|
| 3,125,274 | 3/1964 | Zinn | 229/214 X |
| 3,164,315 | 1/1965 | Kelly . | |
| 3,232,516 | 2/1966 | Arslanian | 229/930 X |
| 3,341,104 | 9/1967 | Loheed et al. | 229/184 X |
| 3,474,951 | 10/1969 | Egleston et al. | 229/184 |
| 4,206,867 | 6/1980 | Skjelby . | |
| 4,482,056 | 11/1984 | Dutcher | 229/160.2 X |
| 4,601,425 | 7/1986 | Bachner | 229/184 X |
| 4,657,175 | 4/1987 | Martensson | 229/930 X |
| 4,714,164 | 12/1987 | Bachner . | |
| 4,989,736 | 2/1991 | Andersson et al. . | |
| 5,029,751 | 7/1991 | Detzel | 229/137 X |
| 5,086,928 | 2/1992 | Lisiecki | 229/137 X |
| 5,118,036 | 6/1992 | Mandersson | 229/137 X |
| 5,152,736 | 10/1992 | Owen et al. . | |

FOREIGN PATENT DOCUMENTS

| | | | |
|---|---|---|---|
| 99649 | 2/1984 | European Pat. Off. | 229/184 |
| 276893 | 8/1988 | European Pat. Off. | 229/138 |

*Primary Examiner*—Allan N. Shoap
*Assistant Examiner*—Christopher J. McDonald
*Attorney, Agent, or Firm*—McAndrews, Held & Malloy Ltd.

[57] ABSTRACT

A gable top carton and its corresponding carton blank are disclosed. The carton includes curved side creases that are defined by curved score lines that divide one or more side panels from a top gabled structure and/or a bottom structure.

39 Claims, 10 Drawing Sheets

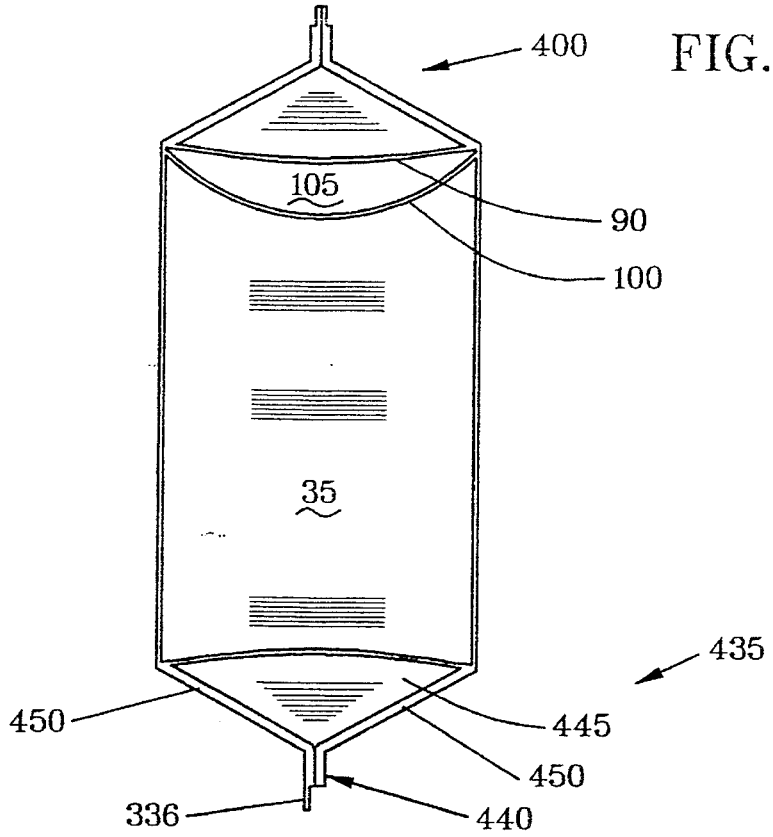
FIG. 4
FIG. 5
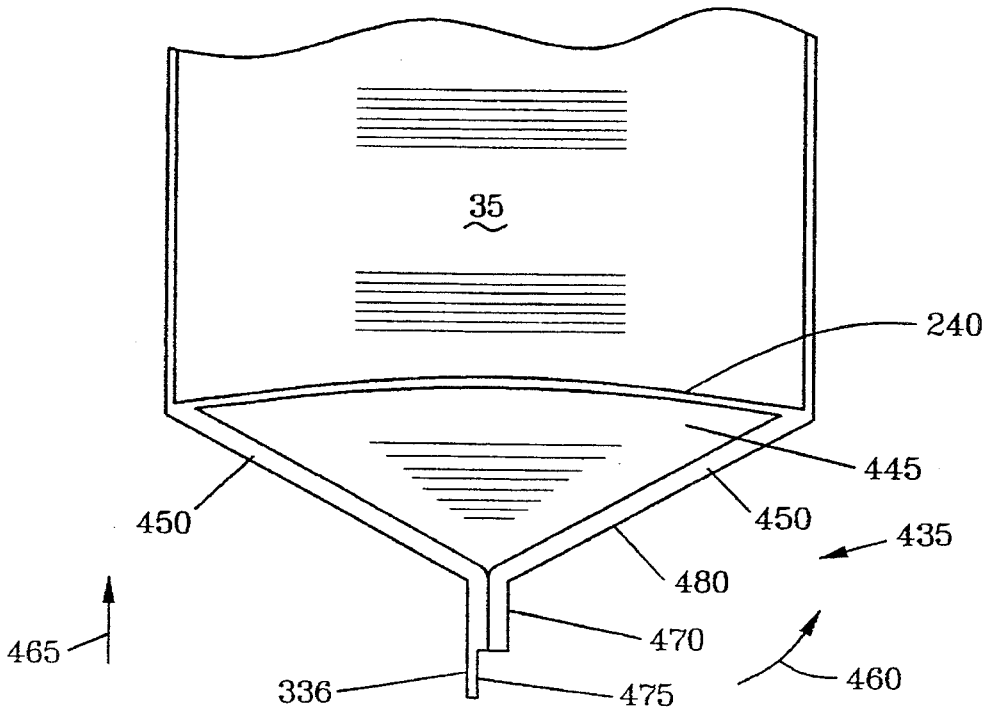

GABLE TOP CARTON AND CARTON BLANK WITH CURVED SIDE CREASES

TECHNICAL FIELD

The present invention is directed to a packaging container and its corresponding blank configuration. More particularly, the present invention is directed to a gable top carton including one or more curved side creases that are each defined by one or more curved score lines.

BACKGROUND OF THE INVENTION

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

When fully folded, filled, and sealed, most gable top cartons include a gabled top structure that engages a plurality of side panels. These side panels form a hollow rectangular body. At the end of this hollow rectangular body opposite the gabled top structure, there is a bottom structure.

The bottom structures of the prior art may be formed in accordance with several different constructions. A first construction is shown in U.S. Pat. No. 3,164,315, issued on Jan. 5, 1965 to N. A. Kelly. As illustrated in that patent, the bottom is formed primarily by four bottom panels that engage the side panels at respective straight score lines that each define a straight crease. Two bottom panels each include two converging score lines. The other two bottom panels do not include further score lines. One of the two non-scored bottom panels is longer than the other. When folded, a portion of the longer, non-scored bottom panel overlaps a portion of the opposite non-scored bottom panel to assist in sealing the bottom structure.

Although the bottom structure of the carton disclosed in the '315 patent provides generally adequate sealing, there is room for improvement. For example, the portion of the longer, non-scored bottom panel that overlaps the opposite non-scored bottom panel forms a ridge which does not allow the container to sit flat on a surface. Instead, the ridge tends to form a fulcrum that renders the carton unstable. Such bottom structures are also subject to bulging which renders them relatively unstable when seated. The bottom seal of such a carton is also subject to wear since it is in direct contact with the surface on which the carton is seated. Additionally, depending on the container contents, the bottom structure may require mechanical sealing strength characteristics beyond those offered by the standard four panel structure.

Another bottom construction is shown in U.S. Pat. No. 5,152,736, issued Oct. 6, 1992, to Owen et al. In that construction, the fin flaps of the bottom structure are cut diagonally and engage bottom flaps at diagonal score lines. During the filling and sealing process, the resulting fin is gripped by specialized sealing jaws and forced upward so that the fin does not interfere with seating of the carton. The side panels engage the bottom structure at straight score lines that define straight creases. The fin is then sealed, in a separate sealing step, by folding the fin flat and heat sealing it to one of the bottom flaps of the container.

The '736 construction has several disadvantages. For example, all four side panels engage the bottom flaps at straight score lines that define straight creases. A downward force is thus exerted on the bottom structure by all four panels, as well as the container contents, to urge the bottom flaps and bottom fin flaps from their non-interfering position when the carton is seated upright. As a result, the bottom seal may become unduly stressed and/or move toward an interfering position. Compensation for this added stress may be achieved, for example, by increasing the thicknesses of the heat sealing layers of the container to increase the strength of the bottom heat seal. However, this results in added production costs, particularly when large production volumes are contemplated.

The gabled tops of standard gable top cartons are typically formed primarily from four top flaps that engage respective side panels of the carton at respective straight score lines that each define a straight crease. Two of the top flaps each include two converging diagonal score lines. The top flaps each engage a respective top fin flap that is divided from the top flap by a respective score line. These structures are folded to form the familiar gable structure that includes an upright fin. One end of the gabled structure constitutes an opening end that has its fin flaps sealed, for example, with an adhesive resin. The user inserts his/her thumbs into an open space beneath the fin flaps to pry them apart and access the container contents. The other end of the gabled structure is typically designated as the closed end and is not designed to be opened by the user.

The conventional gabled top structure suffers from disadvantages in certain situations. In particular, miniature gable top cartons may be difficult to open since the open region beneath the fin flaps at the opening end may not be large enough to accommodate the user's thumbs. The requirement that the open region accommodate the user's thumbs also places a constraint on the height of the gabled structure, even where the carton itself is of a conventional size (i.e., 1 liter).

SUMMARY OF THE INVENTION

A gable top carton and its corresponding carton blank are disclosed. The carton includes curved side creases that are defined by curved score lines that divide one or more side panels from a top gabled structure and/or a bottom structure.

In accordance with one carton embodiment, the carton includes a gabled structure that engages first, second, third, and fourth side panels. The side panels form a hollow rectangular body. The first and third panels form opposite sides of the hollow rectangular body and the second and fourth side panels form opposite sides of the rectangular body. A bottom section engages the first, second, third, and fourth side panels at an end of the side panels opposite the gabled structure. A first curved score line is provided at the engagement between the second side panel and the bottom section. A second curved score line is provided at the engagement between the fourth side panel and the bottom section, the first and second curved score lines defining curved creases which, in turn, define a concave recess into which the bottom section is disposed. A stable concave bottom structure results.

In accordance with another embodiment of a gable top carton, the carton has a top gabled structure having an opening end and a closed end. A plurality of side panels engage the gabled structure, at least one of the side panels engages the gabled structure at the opening end. A first curved score line is provided which defines a curved crease formed at the engagement between the side panel and the gabled structure. A second curved score line is disposed adjacent the first curved score line to define an indent surface between the first and second score lines. A pressure may be applied to the indent surface to deform the surface and enlarge the effective opening area beneath the top fin in the region of the opening end of the top gabled structure. Enlarging the effective opening area provides more room for acceptance of a user's thumbs, or the like, to pry open the top fin and allow user access to the contents of the carton.

In accordance with a still further embodiment, a carton having a generally flattened gable structure is provided. The carton includes first, second, third, and fourth side panels, the first and third side panels being opposite one another and the second and fourth side panels being opposite one another. The first, second, third, and fourth flaps respectively engage the first, second, third, and fourth side panels. Two opposite flaps are each provided with a pair of oppositely directed diagonal score lines that converge at an apex. First, second, third, and fourth fin flaps respectively engage the first, second, third, and fourth flaps. A score line that is generally wider than other score lines dividing the flaps from the fin flaps extends between the apices of the two opposite flaps. A fin extension tab extends from one of the fin flaps. The fin extension tab engages one of the fin flaps at a wide score line to allow the fin extension tab to fold over the fin flaps and contact and seal to an exterior surface of one of the flaps.

Additional bottom structures are contemplated which include further score lines that allow the bottom to fold more easily and that effectively absorb material so that the folded bottom structure is not as wide as a folded bottom structure without the added score lines. This provides, among other things, a more stable and structurally sound recessed bottom structure.

BRIEF DESCRIPTION OF THE DRAWINGS

FIGS. 4 and 5 are side elevational views of the carton at a further intermediate folded stage illustrating folded top and bottom gabled structures.

DETAILED DESCRIPTION OF THE PREFERRED EMBODIMENT

Figure 1:
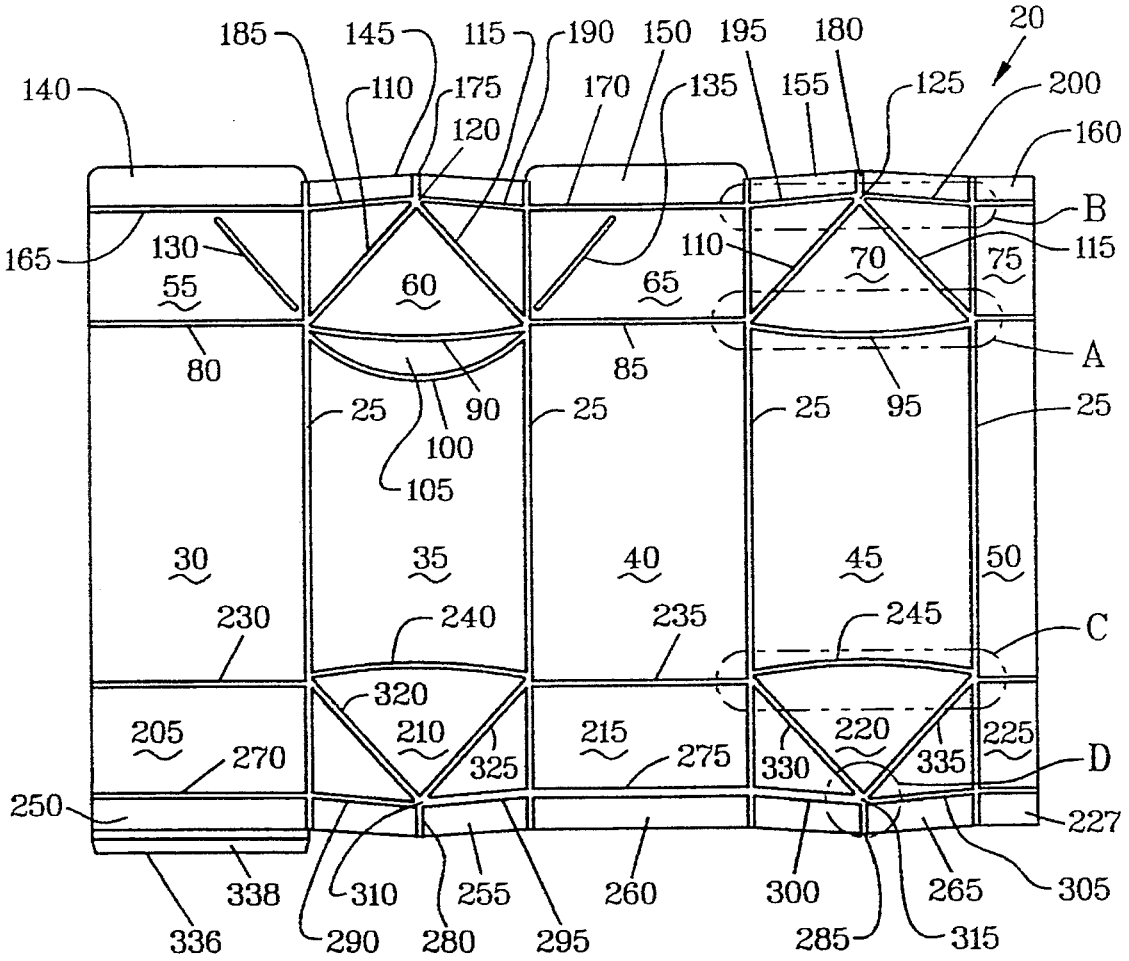
FIG. 1 is a plan view of one embodiment of a carton blank constructed in accordance with the teachings of the present invention.
Figure 1A:
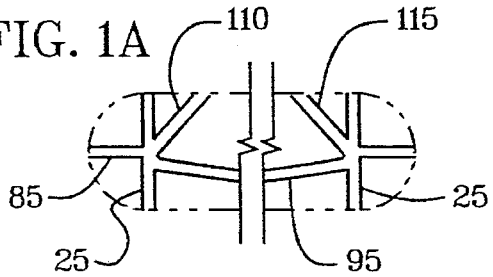
FIGS. 1A–1D are exploded views of various score lines of the carton blank shown in FIG. 1.
Figure 1B:
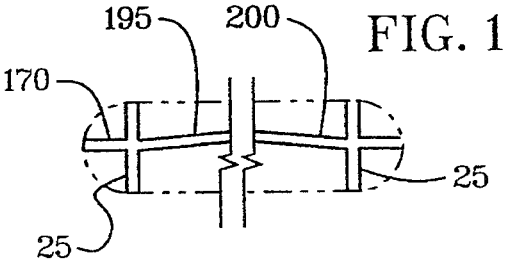

FIG. 1 illustrates one embodiment of a blank that may be used to form a carton in accordance with the teachings of the present invention. The carton blank 20 has a plurality of panels that are effectively separated from one another by a plurality of score lines. The carton blank 20 is divided by four vertical score lines 25 into first, second, third, fourth and fifth side panels respectively noted as 30, 35, 40, 45, and 50. The fifth side panel 50 has a smaller width than the other side panels and, as will be shown in further detail below, is used to side seal the carton. At the top of the carton blank 20, the side panels 30, 35, 40, 45, and 50 engage respective first, second, third, fourth, and fifth top flaps 55, 60, 65, 70, and 75. The first side panel 30 and the adjacent first top flap 55 are 20 divided from one another by a straight score line 80. Likewise, the third side panel 40 and the adjacent third top flap 65 are divided from one another by a straight score line 85. The second side panel 35 and the adjacent second top flap 60 are divided from one another by a curved score line 90. Likewise, the fourth side panel 45 and the adjacent fourth top flap 70 am divided from one another by a curved score line 95. The second side panel 35 includes a further curved score line 100 adjacent the curved score line 90. As will be explained in further detail below, the curved score lines 90 and 100 of the second side panel 35 define an indent surface 105 therebetween.

Further score lines are provided in the top flaps to assist in defining the creases that will ultimately be made when the blank 20 is folded into a gable top carton. The second and fourth top flaps 60 and 70 each include a pair of diagonal lines 110 and 115 that converge at respective apices 120 and 125. The first and third top flaps 55 and 65 each include a respective diagonal score line 130 and 135 that, as will be apparent from the following discussion, assists in defining the opening end of the carton.

Immediately adjacent the first, second, third, fourth, and fifth top flaps are respective first, second, third, fourth, and fifth top fin flaps 140, 145, 150, 155, and 160. The first and third fin flaps 140 and 150 are generally rectangular with curved corners. The first top panel 55 and the third top panel 65 are divided from their respective top fin flaps 140 and 150 by respective straight score lines 165 and 170. The second and fourth fin flaps 145 and 155 include respective angled top edges. The second and fourth top fin flaps 60 and 70 each include a respective vertical score line 175 and 180. Angled score lines 185, 190, 195, and 200 proceed from the apices 120 and 125 of the second and fourth top flaps and divide the second and fourth top flaps 60 and 70 from the respective second and fourth top fin flaps 145 and 155. The angled score lines 185, 190, 195, and 200 are generally parallel to the angled top edges of the second and fourth top fin flaps 145 and 155.

At the end of the blank 20 opposite the top panel structures, the first, second, third, fourth, and fifth side panels engage respective first, second, third, fourth, and fifth bottom flaps 205, 210, 215, 220 and 225. The first side panel 30 and the adjacent first bottom flap 205 are divided from one another by a straight score line 230. Likewise, the third side panel 40 and the adjacent third bottom flap 215 are divided from one another by a straight score line 235. The second side panel 35 and the adjacent second bottom flap 210 are divided from one another by a curved score line 240. Likewise, the fourth side panel 45 and the adjacent fourth bottom flap 220 are divided from one another by a curved score line 245.

Immediately adjacent the first, second, third, fourth, and fifth bottom flaps are respective first, second, third, fourth, and fifth bottom fin flaps 250, 255, 260 265, and 227. The first and third bottom fin flaps 250 and 260 are generally rectangular and, in the illustrated embodiment, are not as wide as the corresponding first and third top fin flaps 140 and 150. The first bottom flap 205 and the third bottom flap 215 are divided from their respective bottom fin flaps 250 and 260 by respective straight score lines 270 and 275. The second and fourth bottom fin flaps 255 and 265 include respective angled bottom portions. The second and fourth bottom fin flaps 255 and 265 each include a respective vertical score line 280 and 285. Angled score lines 290, 295, 300, and 305 proceed from the apices 310 and 315 of the converging score lines 320, 325, 330, and 335 of the second and fourth bottom flaps 210 and 220. The angled score lines divide the second and fourth bottom flaps 210 and 220 from the respective second and fourth bottom fin flaps 255 and 265. The angled score lines 290, 295, 300, and 305 are generally parallel to the corresponding angled bottom edges of the first and second bottom fin flaps 255 and 265. Score lines 295, 275, and 300 extend between the apices 310 and 315 and are of a greater width than the score lines 270, 290, and 305. For example, the score lines 275, 295, and 300 may be approximately twice as wide as score lines 270, 290 and 305.

A fin extension tab panel 336 extends from the first bottom fin flap 250. The extension tab panel 336 is divided from the first bottom fin flap 250 by a wide score line 338. For example, the wide score line 338 may have a width that is approximately twice as wide as the width of score line 270.

The top and bottom curved creases 90, 95, 240, and 245 may have different radii depending on the size of the carton. For example, a 47 mm×47 mm cross section carton may have top curved creases with radii of 200 mm and bottom curved creases with radii of 200 mm. A 70 mm×70 mm carton may have top curved creases with radii of 350 mm and bottom curved creases with radii of 700 mm. A 95 mm×95 mm carton may have top curved creases with radii of 600 mm and bottom curved creases with radii of 1200 mm. The curved crease 100 may, for example, have a radius of 75 mm for a 70 mm×70 mm carton.

Figure 1C:
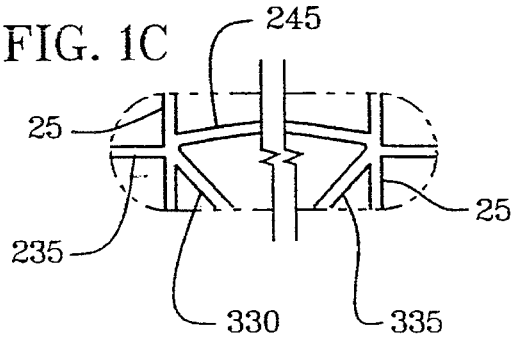
Figure 1D:
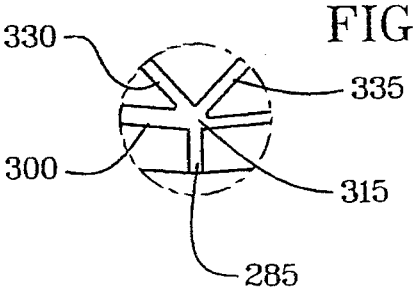

FIGS. 1A, 1B, 1C, and 1D are exploded sectional views respectively of sections A, B, C, and D of FIG. 1. The exploded figures illustrate the relative orientation and position of the score lines of each of the respective labelled sections. As illustrated in FIG. 1 A, the top curved score lines 90 and 95 are offset below the score line 85. Similarly, as illustrated in FIG. 1C, the bottom curved score lines 240 and 245 are offset above the score line 235.

Figure 2:
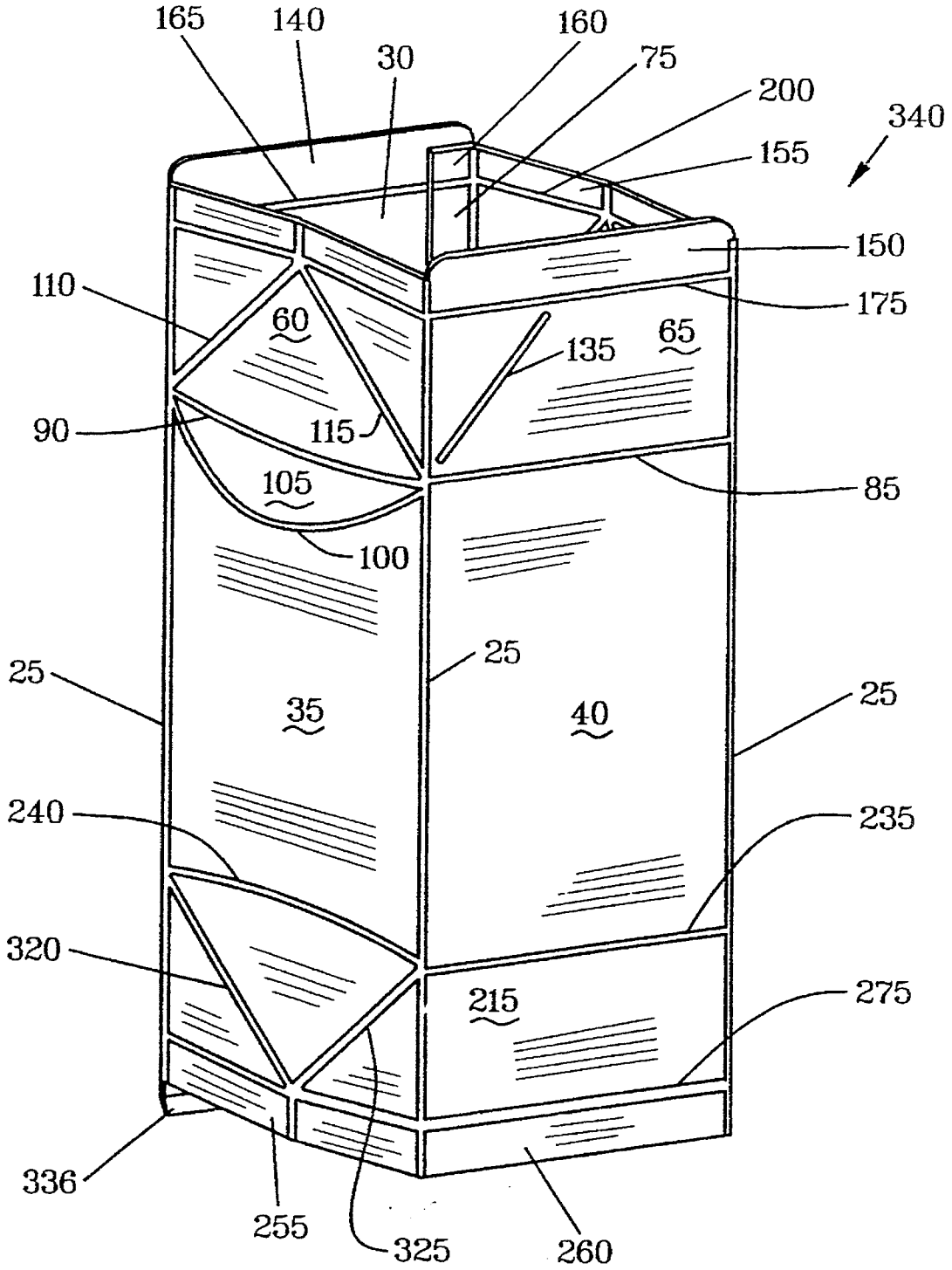
FIG. 2 is a perspective view of the carton blank formed into a hollow rectangular body after sealing the first and fifth side panels to one another.

FIG. 2 illustrates the blank 20 of FIG. 1 at an intermediate folded stage. At this stage, a hollow rectangular structure 340 is formed by folding the carton blank 20 of FIG. 1 along the vertical score lines 25 to form vertical creases. The exterior surfaces of the fifth top fin flap 160, the fifth top flap 75, the fifth side panel 50, the fifth bottom flap 225, and the fifth bottom fin flap 227 are joined to the interior surfaces of the edge of the corresponding first top fin flap 140, the first top flap 55, the first side panel 30, the first bottom flap 205, and the first bottom fin flap 250. This joining may occur, for example, by heat sealing the panels together. Other adhesion methods are also contemplated.

The intermediately folded structure illustrated in FIG. 2 is further foldable to form top and bottom gabled structures The top fin flaps and top flaps of the structure shown in FIG. 2 are foldable along the illustrated score lines to form a top gabled structure. Similarly, the bottom fin flaps and the bottom flaps of the structure shown in FIG. 2 are foldable along the illustrated score lines to form a bottom gabled structure.

Figure 3:
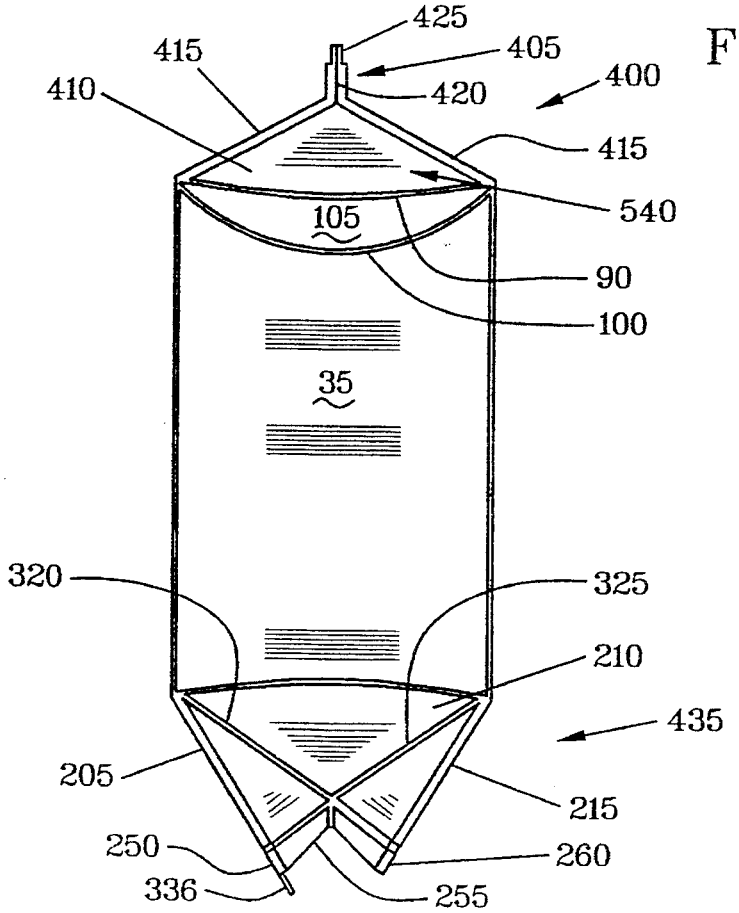
FIG. 3 is a side elevational view of the carton at an intermediate folded stage in which the top gabled section has been sealed.
Figure 6:
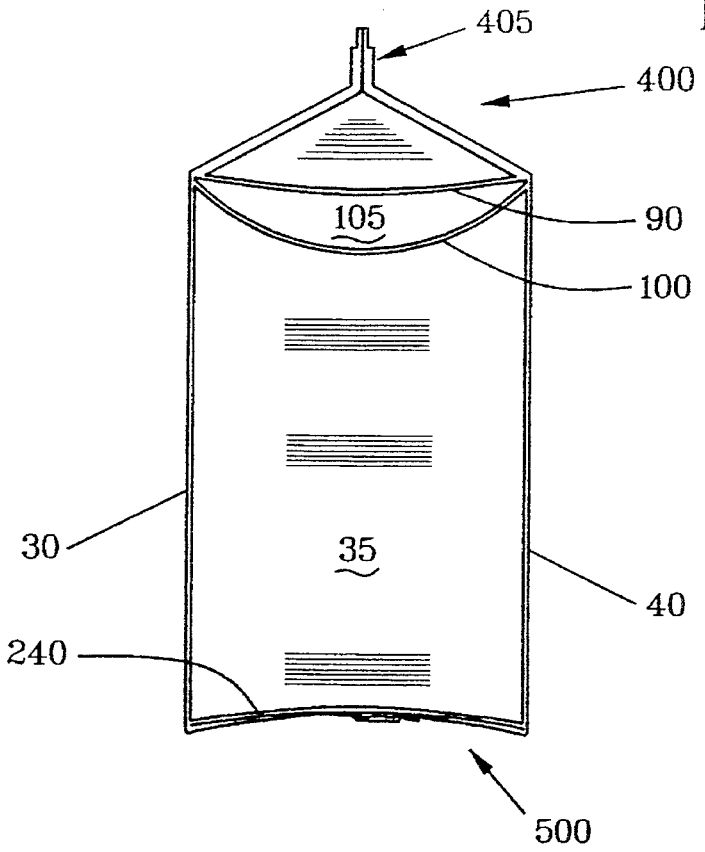
FIGS. 6 and 7 are side elevational views of the fully folded carton.
Figure 7:
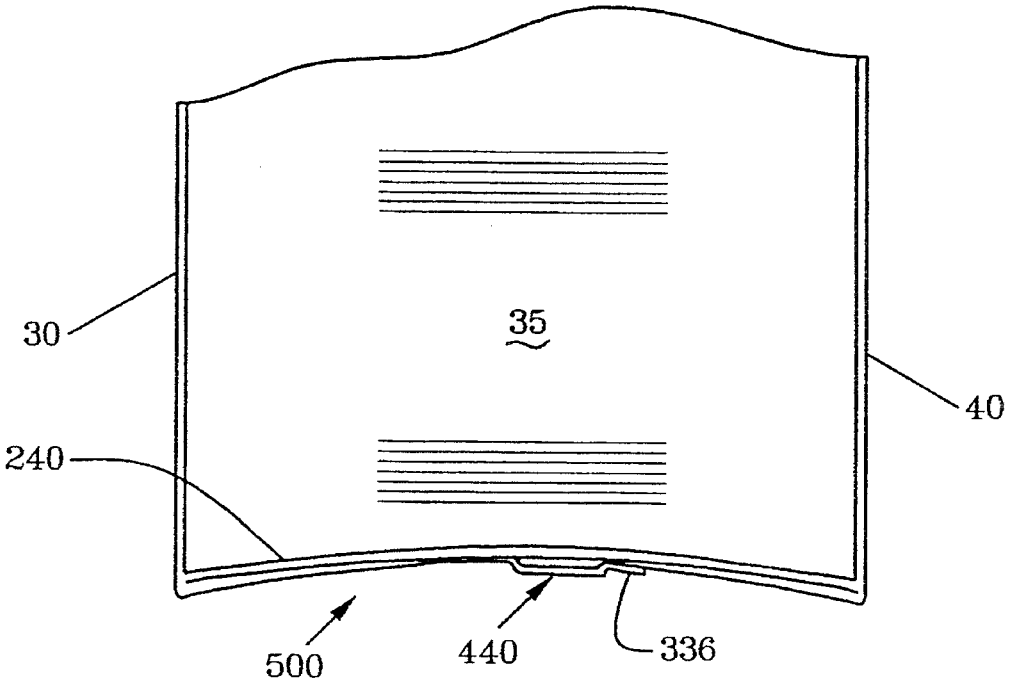

FIG. 3 illustrates the blank 20 of FIG. 1 at a further intermediate folded stage. In this stage, the top gabled structure 400 has been fully formed. The top gabled structure 400 includes an upstanding fin 405 and underlying and overlying gabled walls 410 and 415. The upstanding fin 405 includes a four layered portion 420 and a two layered portion 425. The four layered portion 420 comprised of the overlapping sections of all of the top fin flaps while the two layered portion 425 is comprised of the upper portions of the first and third top fin flaps. The fin flaps are joined together, for example, by heat sealing.

The underlying gabled wall 410 of the top gabled structure 400 engages side panel 35 at the curved score line 90 (see also FIG. 1) which, in this folded condition, defines a curved crease. The score line 100 extends across the width of the side panel 35 adjacent the curved crease formed at score line 90. The area between the score line 100 and the curved crease constitutes an indent surface 105.

FIG. 3 also illustrates the bottom gabled section 435 in a partially folded state. In this state, the first and third bottom flaps 205 and 215 and bottom fin flaps 250 and 260 are urged toward one another while the second and fourth bottom flaps 210 and 220 and bottom fin flaps 255 and 265 are likewise urged toward one another. In this process, the first and third bottom flaps are broken along the converging diagonal score lines 320, 325, 330, and 335 (see also FIG. 1) to allow the bottom flaps 210 and 220 to fold toward one another.

FIGS. 4 and 5 illustrate the blank 20 of FIG. 1 in a still progressively further folded stage. In this stage, the bottom gabled structure 435 is fully formed and includes a bottom fin 440, underlying and overlying gabled walls 445 and 450 (only one underlying wall illustrated), and the fin extension tab 336. The underlying walls 445 of the bottom gabled structure 435 engage the second and fourth side panels 35 and 45 at the curved score lines 240 and 245 and define respective curved creases. The bottom fin 440, unlike the top fin of the present embodiment, includes only a four layered portion that is defined by overlapping sections of all of the bottom fin flaps.

The bottom gabled structure 435 interferes with seating of the formed carton while in the position illustrated in FIGS. 4 and 5. Accordingly, the fin 440 and fin extension tab 336 of the bottom gabled structure 435 are folded over the overlying gabled wall 450 in the direction shown by arrow 460 of FIG. 5. Once the fin 440 and fin extension tab 336 are folded over the overlying gabled wall 450, the bottom gabled structure 435 is urged upward in the direction indicated by arrow 465 of FIG. 5. The surface 470 of the fin 440 and the surface 475 of the fin extension tab 336 are then joined to the exterior surface 480 of the overlying gabled wall 450. Wide score line 338 (FIG. 1) allows the fin extension tab 336 to extend over the edges of the fin 440 and seal to the surface 480 without the creation of an undue amount of space between the fin 440 and fin extension tab 336 that might otherwise compromise the integrity of the bottom seal.

Figure 8:
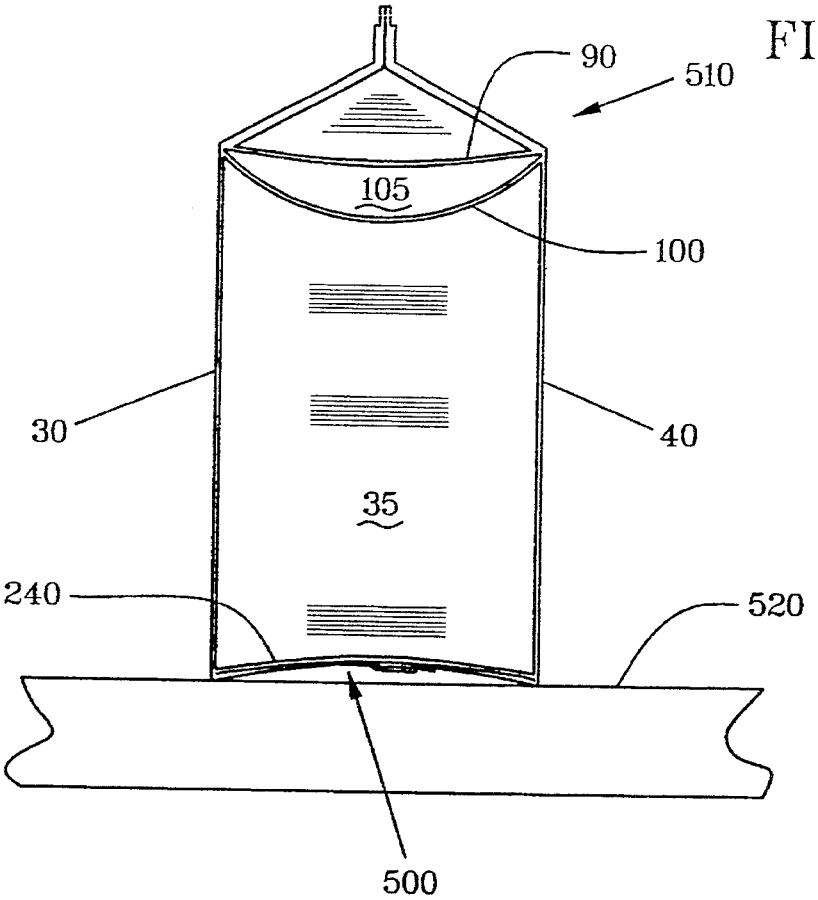
FIG. 8 is a side elevational view of the fully folded carton seated on a flat surface.
Figure 9:
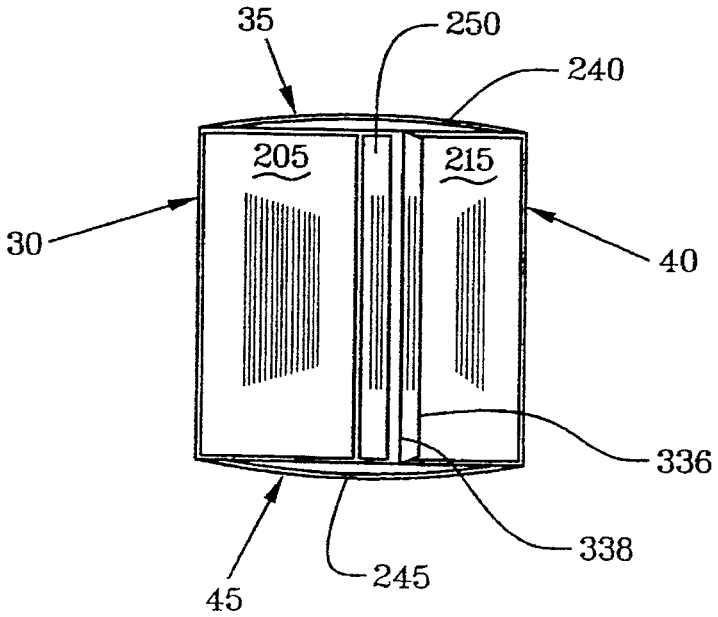
FIG. 9 is a bottom view of the carton showing the gable bottom and extension tab after both have been folded and sealed.

The resulting folded gabled structure is shown in FIGS. 6, 7, 8, and 9. As illustrated, the folded gabled structure 500 is disposed in a concave recess that is defined by the curved score lines 240 and 245 (FIG. 1) along which the curved creases are formed. In this position, as shown in FIG. 8, the folded gabled structure 500 does not interfere with the seating of the formed carton 510 on a flat surface 520. Instead of resting on the bottom gabled structure, the bottom edges of the first and third side panels 30 and 40 support the carton 510. This configuration allows the integrity of the bottom seal of the carton to be maintained since the folded gabled structure is not subject to wear from frictional contact with the flat surface 520 on which the carton 510 is seated. Additionally, the magnitude of the natural downward force on the folded gabled structure is not as great as would be exerted in the absence of the curved creases. The construction of the bottom structure illustrating the wide score line 338 is shown in detail in FIG. 9 which is a bottom view of the carton 510.

Figure 10:
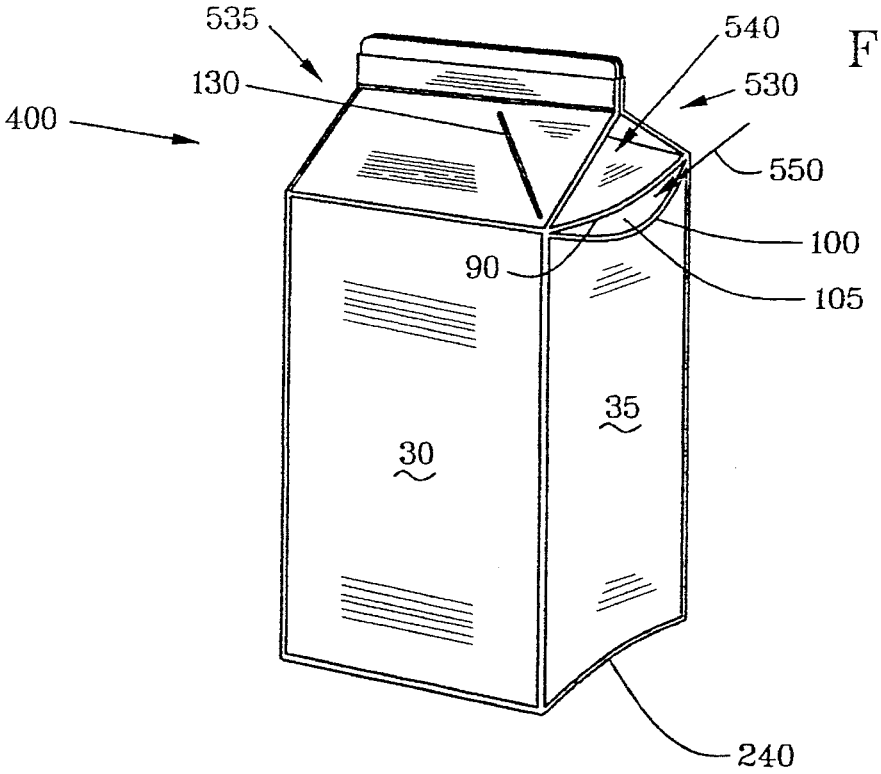
FIG. 10 a perspective view of the folded and sealed carton.

Referring to FIG. 10, the top gabled structure 400 includes an opening end 530 and a closed end 535. The opening end 530 of the top gabled structure 400 engages the second side panel 35 at the curved score line 90 (FIGS. 1 and 3) that defines a curved crease. An open area 540 is provided to accept, for example, the thumbs of the user to allow the user to pry the layers of the fin 405 apart in the region of the opening end 530.

In many instances, the open area 540 alone may be insufficient to allow the user to pry the carton open. For example, where the top gabled structure has a low profile, the open area 540 may not be large enough to accommodate the thumbs of the user. Similarly, the open area 540 may not be large enough where the carton 340 is relatively small in size.

To overcome many of the problems associated with small opening areas, the carton 340 includes the further curved score line 100 that extends across the width of the second side panel 35. Between the curved score line 90 and curved score line 100 there is the indent surface 105. The indent surface 105 may be urged in the direction shown by arrow 550 to flatten the indent surface area 105 and provide a larger effective opening area 540. With the effective opening area increased, it becomes easier for the user to obtain a position from which the top fin 405 adjacent the opening end 530 may be pried open.

Figure 11:
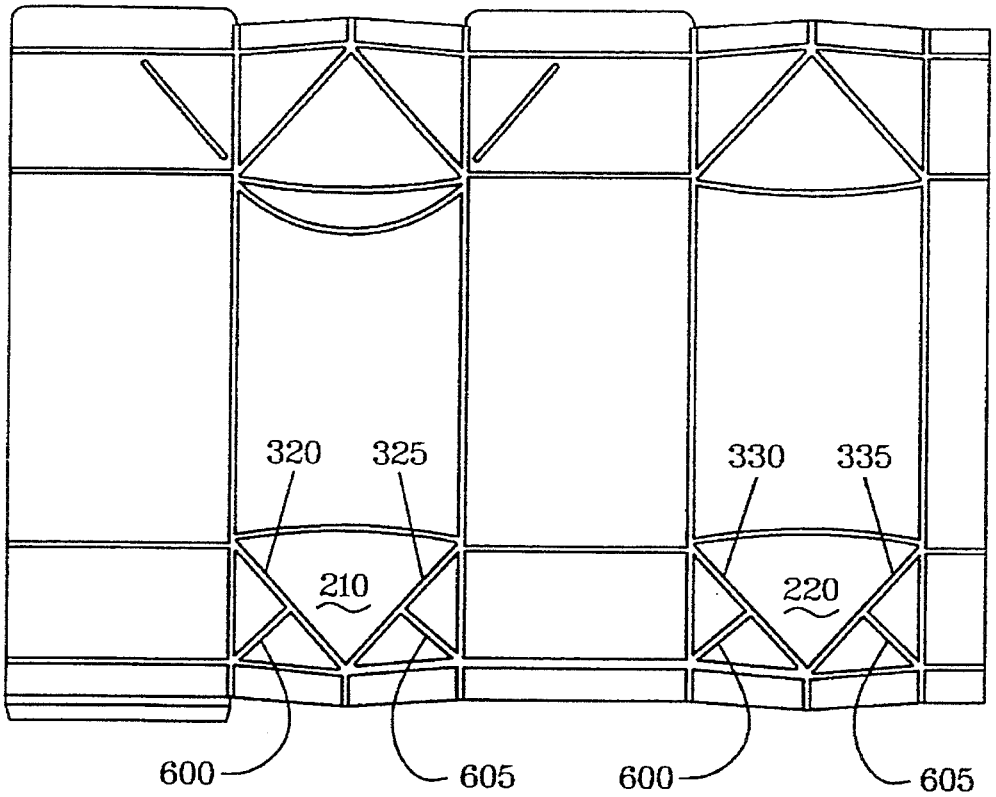
FIGS. 11–14 illustrate carton blanks having various score line configurations for the bottom structure of the carton.

FIGS. 11–14 illustrate carton blanks having added score lines which assist in providing a more structurally sound recessed bottom structure than bottom structures that do not have such added score lines. In the embodiment of FIG. 11, diagonal score lines 600 and 605 extend from the converging score lines 320, 325 to the lower corners of the second bottom flap 210. A similar score line configuration is supplied on the fourth bottom flap 220 as well.

Figure 12:
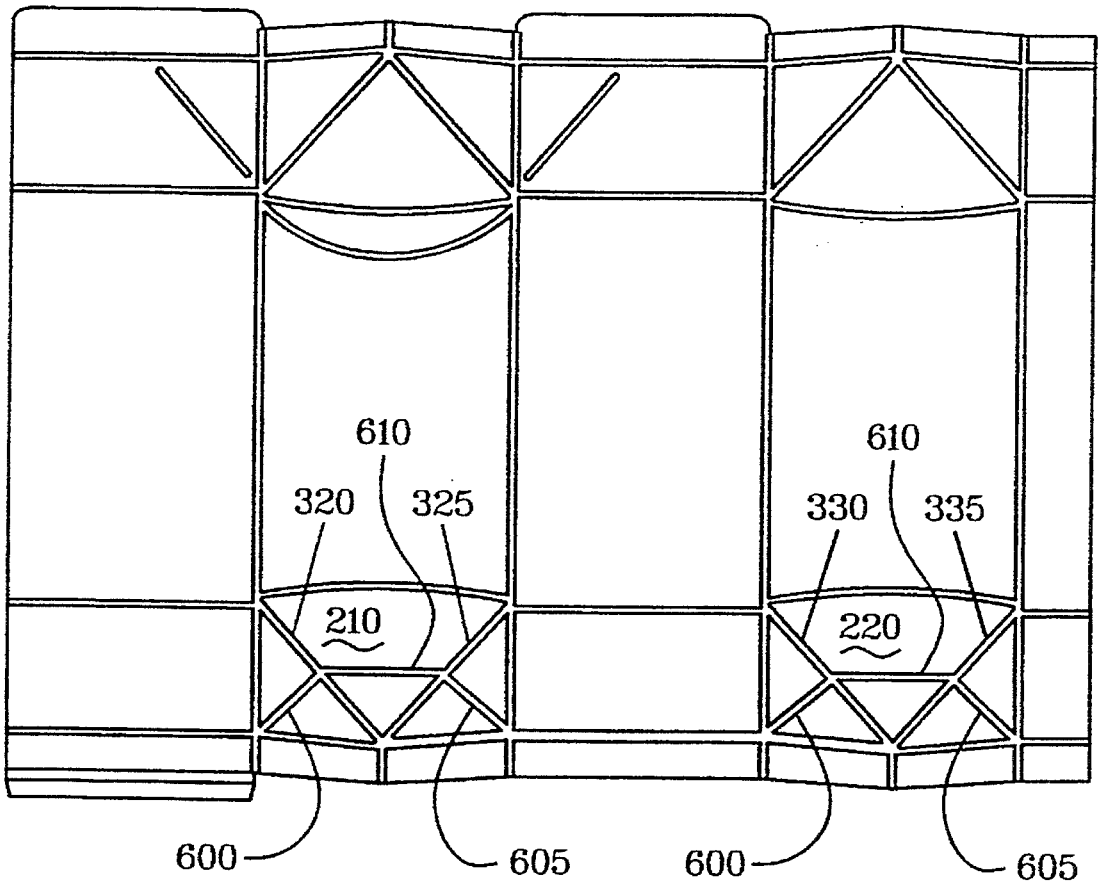

The embodiment of FIG. 12 is similar to the embodiment shown in FIG. 11 except that an added horizontal score line 610 is provided that interconnects the diagonal score lines 600 and 605. A similar score line configuration is supplied on the fourth bottom flap 220 as well.

Figure 13:
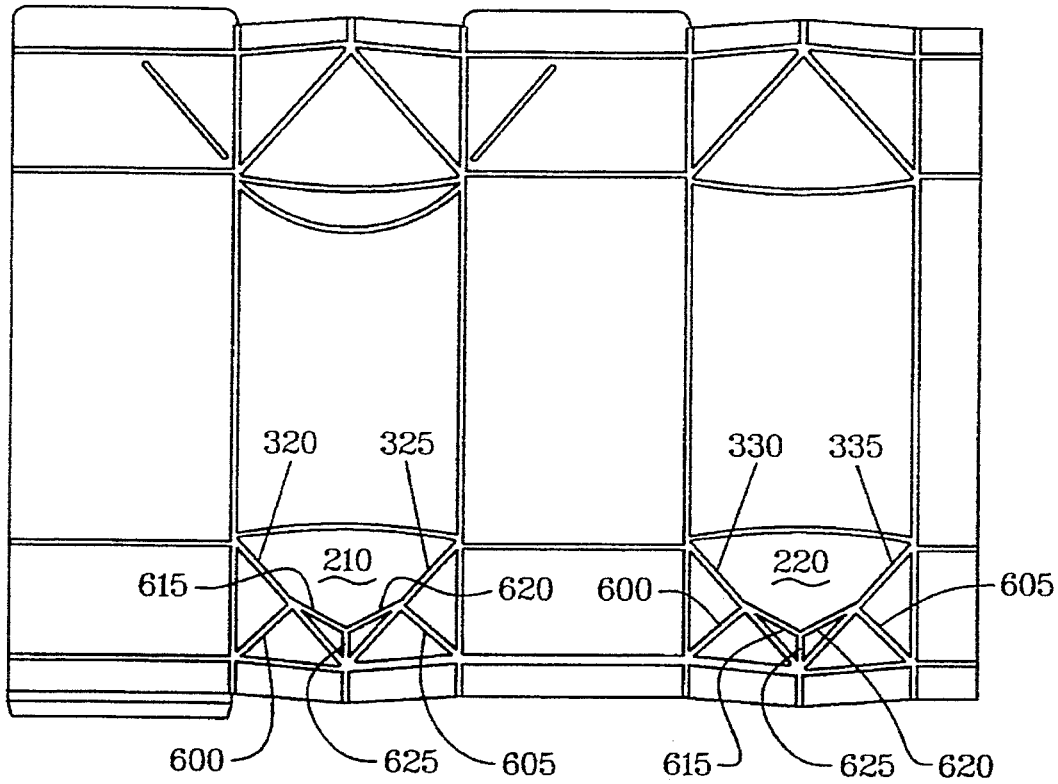

The embodiment of FIG. 13 is similar to the embodiment shown in FIG. 12 except that a generally Y-shaped score line configuration is used in lieu of the horizontal score line 610. The generally Y-shaped score line configuration includes a pair of diagonal arm portions 615 and 620 which intersect a vertical score line 625. The diagonal arm portions 615 and 620 intersect at the mid-portions of diagonal score lines 320, 325 and 330, 335. This score line configuration is provided on both the second and fourth bottom flaps 210 and 220.

Figure 14:
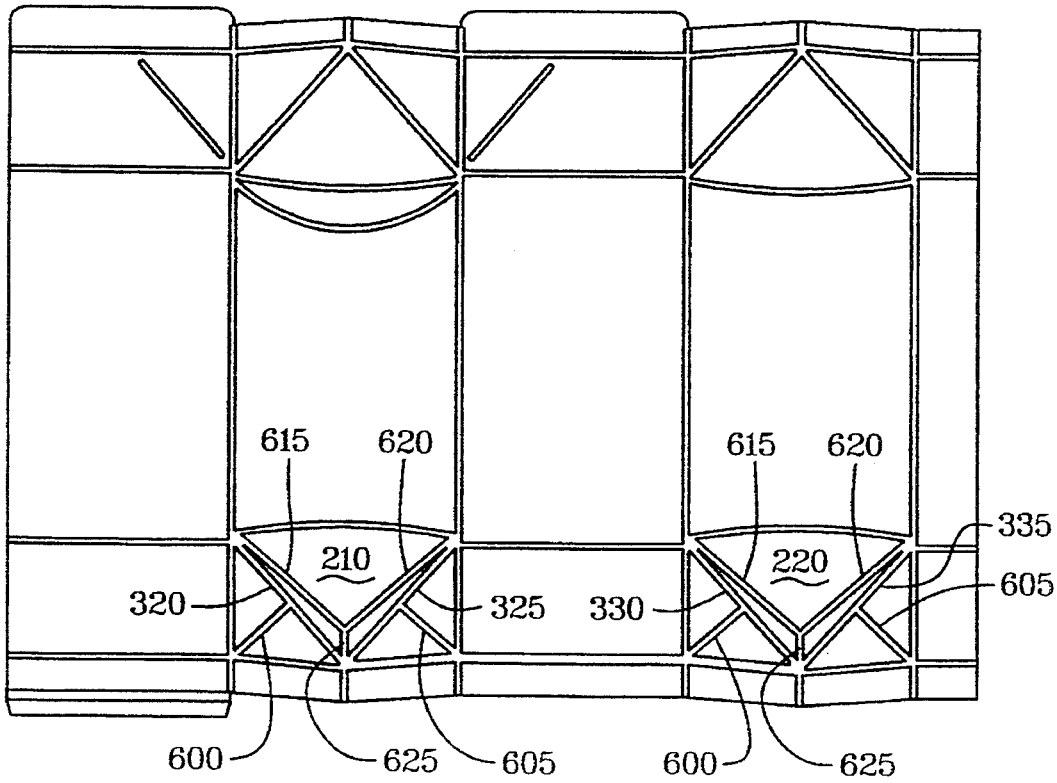

The embodiment of FIG. 14 is similar to the embodiment of FIG. 13 except that the diagonal arm portions 615 and 620 intersect the diagonal score lines 320, 325 and 330, 335 at the upper corners of the bottom flaps 210 and 220.

Figure 15:
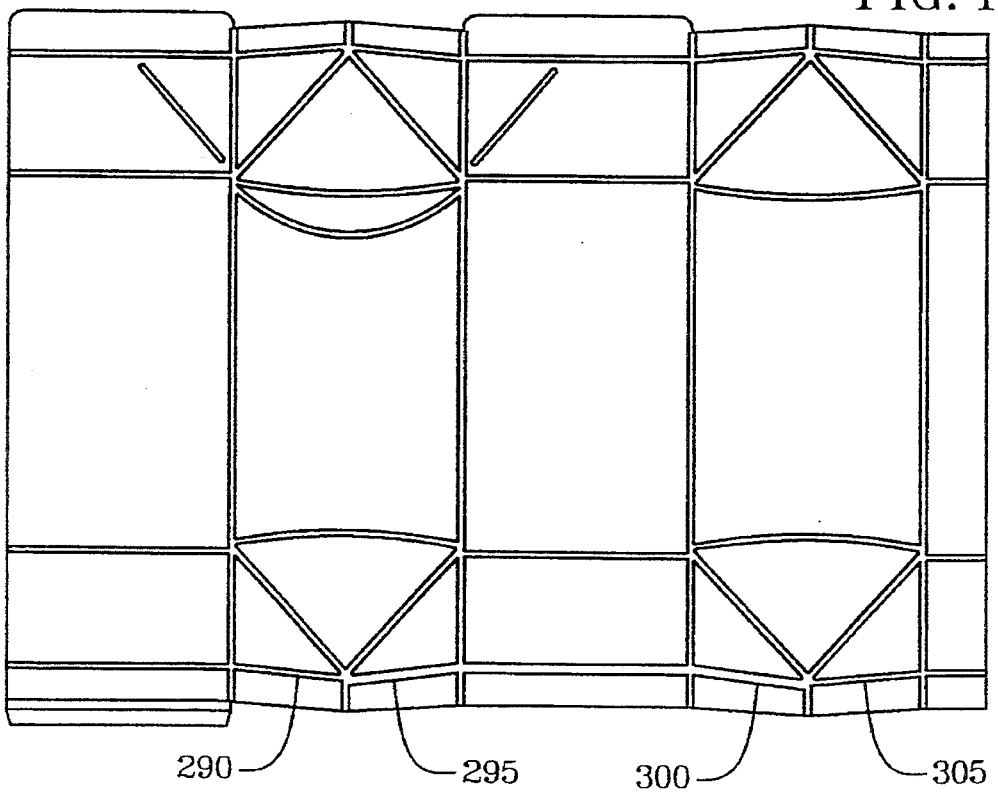
FIG. 15 illustrates a carton blank having an alternative orientation of the wide score lines that proceed accross the bottom portions of the bottom flaps.

FIG. 15 illustrates an alternative orientation between the wide score lines 295, 300 and score lines 290, 305. In this alternative orientation, the upper and lower portions of the wide score lines 295, 300 are slightly below the upper and lower portions of the score lines 290, 305.

Figure 16:
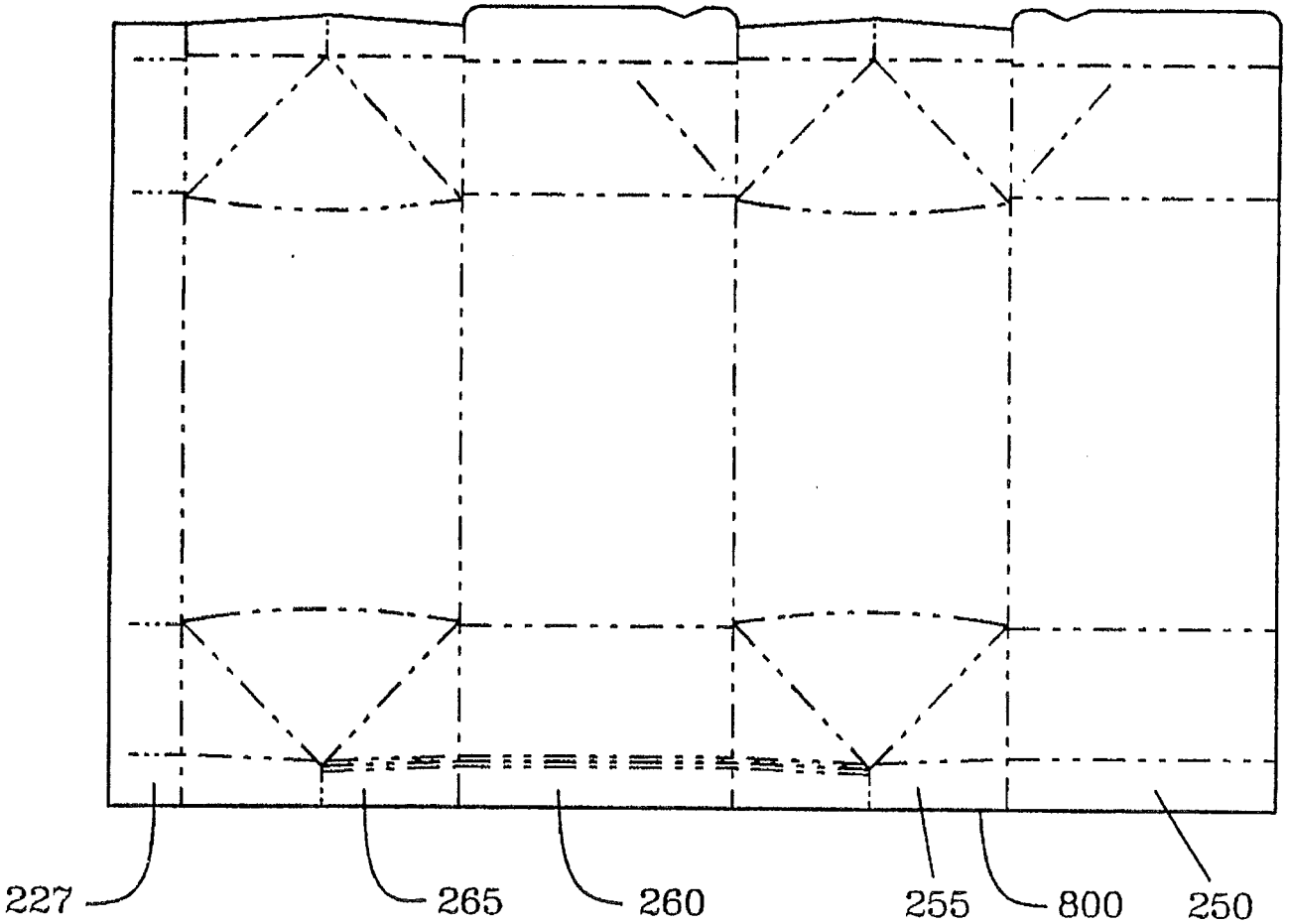
FIG. 16 illustrates a carton blank wherein the bottom of the blank is formed along a straight cut.

FIG. 16 illustrates an alternative embodiment wherein the bottom of fin flaps 250, 255, 260, and 265 proceed along a straight edge 800.

Although the present invention has been described with reference to specific embodiments, those of skill in the art will recognize that changes may be made thereto without departing from the scope and spirit of the invention as set forth in the appended claims.

I claim as my invention:

1. A carton comprising:

a) a plurality of side panels including first and second non-adjacent side panels, each of said first and second non-adjacent side panels having a respective curved score line, each of the respective curved score lines having endpoints generally vertically equidistant from its respective maximum; and b) a gabled structure having a fin disposed transversely to the curved score lines, the gabled structure engaging said first and second side panels at said curved score lines, said curved score lines defining a concave recess into which said gabled structure is folded, said fin of said gabled structure being sealed to a generally flattened condition and extending only partially toward a bottom edge of the carton.

2. A carton as claimed in claim 1 wherein said gabled structure is disposed at the bottom of said carton, said carton further comprising a top gabled structure engaging said plurality of side panels at the end of said plurality of side panels opposite said gabled structure, said top gabled structure engaging said first and second non-adjacent panels at respective first and second top curved score lines.

3. A carton as claimed in claim 2 wherein said top gabled structure has an opening end, said first side panel engaging said top gabled structure at said opening end.

4. A carton as claimed in claim 3 and further comprising a further curved score line disposed adjacent said first curved score line, said first and further curved score lines defining a user deformable indent surface between said first curved score line and said still further curved score line.

5. A carton as claimed in claim 1 wherein said maximum of each of said curved score line occurs proximate a midpoint of the respective curved score line.

6. A carton as claimed in claim 5 wherein said fin extends transversely proximate and between the midpoints of the curved score lines and wherein the fin extends less than half the distance between the midpoints and said bottom edge.

7. A gable top carton comprising:

a) a top gabled structure;

b) first, second, third, and fourth side panels engaging said gabled structure, said side panels forming a hollow rectangular body, said first and third side panels forming opposite sides of said hollow rectangular body, and said second and fourth side panels forming opposite sides of said hollow rectangular body;

c) a bottom gabled structure engaging said first, second, third, and fourth side panels at an end of said side panels opposite said top gabled structure, said bottom gabled structure having a fin;

d) a first curved score line at the engagement between said second side panel and said bottom gabled structure, said first curved score line extending between said first and third side panels and having endpoints generally vertically equidistant from its maximum; and e) a second curved score line at the engagement between said fourth side panel and said bottom gabled structure, said second curved score line extending between said first and third side panels and having endpoints generally vertically equidistant from its maximum, said first and second curved score lines defining a concave recess into which said bottom gabled structure is folded, said fin of said gabled structure being sealed to a flattened condition and extending only partially toward a bottom edge of one of said first and third side panels.

8. A gable top carton as claimed in claim 7 wherein said gabled structure comprises:

a) first, second, third, and fourth bottom flaps respectively engaging said first, second, third, and fourth side panels, said second and fourth bottom flaps each including a pair of oppositely directed diagonal score lines that converge at an apex; and b) first, second, third, and fourth bottom fin flaps respectively engaging said first, second, third, and fourth bottom flaps.

9. A gable top carton as claimed in claim 8 wherein said folded gabled structure further comprises a plurality of additional score lines disposed on said second and fourth bottom flaps.

10. A gable top carton as claimed in claim 8 wherein said second bottom panel comprises first and second diagonal score lines extending between each score line of said pair oppositely directed diagonal score lines and a respective corner of said second bottom panel.

11. A gable top carton as claimed in claim 10 and further comprising a horizontal score line extending between said first and second score lines and intersecting said first and second score lines where said first and second score lines intersect each score line of said pair of oppositely directed diagonal score lines.

12. A gable top carton as claimed in claim 10 wherein said second bottom panel further comprises a generally Y-shaped score line configuration disposed between said pair of oppositely directed score lines.

13. A gable top carton as claimed in claim 10 wherein said fourth bottom panel comprises third and fourth diagonal score lines extending between each score line of said pair of diagonal score lines and a respective corner of said bottom panel.

14. A gable top carton as claimed in claim 13 and further comprising a horizontal score line extending between said first and second score lines and intersecting said first and second score lines where said first and second score lines intersect each score line of said pair of oppositely directed diagonal score lines.

15. A gable top carton as claimed in claim 13 wherein said second bottom panel further comprises a generally Y-shaped score line configuration disposed between said pair of oppositely directed score lines.

16. A gable top carton as claimed in claim 8 and further comprising a score line extending between the apex of said second bottom flap and the apex of said fourth bottom flap, said score line being generally wider than other score lines separating said bottom flaps from said bottom fin flaps.

17. A gable top carton as claimed in claim 16 and further comprising a fin extension tab extending from said first bottom fin flap.

18. A gable top carton as claimed in claim 17 wherein said fin extension tab engages said first bottom fin flap at a wide score line to allow said fin extension tab to fold over said bottom fin flaps and contact an exterior surface of said third bottom flap for sealing thereto when said bottom gabled structure is folded into said concave recess.

19. A gable top carton as claimed in claim 18 wherein said fin extension tab and said third bottom flap are coated with a thermoplastic material and wherein said fin extension tab heat seals to said third bottom flap.

20. A carton as claim in claim 7 wherein ,said maximum of each of said first and second curved score line occurs proximate a midpoint of the respective first and second curved score line.

21. A carton as claimed in claim 20 wherein said fin extends transversely proximate and between the midpoints of the curved score lines and wherein the fin extends less than half the distance between the midpoints and said bottom edge.

22. A carton having a generally flattened gable structure, said carton comprising:

a) first, second, third, and fourth side panels, said first and third side panels being opposite one another and said second and fourth side panels being opposite one another;

b) first, second, third, and fourth flaps respectively engaging said first, second, third, and fourth side panels, two opposite flaps each including a pair of oppositely directed diagonal score lines that converge at an apex;

c) first, second, third, and fourth fin flaps respectively engaging said first, second, third, and fourth flaps;

d) a score line extending between the apex of said two opposite flaps, said score line being generally wider than other score lines separating said flaps from said fin flaps; and e) a fin extension tab extending from one of said fin flaps, said fin extension tab engaging said one of said fin flaps at a wide score line to allow said fin extension tab to fold over said fin flaps and contact an exterior surface of one of said flaps for sealing thereto.

23. A carton as claimed in claim 22 wherein said fin extension tab is heat sealed to said one of said flaps.

24. A carton as claimed in claim 22 wherein said two opposite flaps having the pair of oppositely directed diagonal score lines are the second and fourth flaps.

25. A carton as claimed in claim 22 wherein said extension tab extends from said first fin flap.

26. A carton as claimed in claim 22 wherein said fin extension tab and said third flap are coated with a thermoplastic material and wherein said fin extension tab heat seals to said third flap.

27. A blank for forming a gable top carton comprising:

a) first, second, third, and fourth side panels, said side panels divided from one another by a plurality of vertical score lines;

b) first, second, third, and fourth bottom flaps respectively adjacent said first, second, third, and fourth side panels, said bottom flaps divided from one another by said plurality of vertical score lines;

(c) first, second, third, and fourth bottom fin flaps respectively adjacent said first, second, third, and fourth bottom flaps, said bottom fin flaps being divided from one another by said plurality of vertical score lines, said bottom flaps being divided from said bottom fin flaps by one or more generally horizontal score lines, said bottom fin flaps being Shorter than said bottom flaps; and d) at least two non-adjacent side panels being divided from at least two non-adjacent bottom flaps by respective curved score lines, each of said respective curved score lines having endpoints generally vertically equidistant from their respective maximums, each of said two non-adjacent bottom flaps including a pair of converging score lines.

28. A blank as claimed in claim 27 wherein said two non-adjacent side panels are said second and fourth side panels and wherein said blank further comprises a fin extension tab adjacent said first bottom fin flap, said fin extension tab being divided from said first bottom fin flap by a wide score line.

29. A blank as claimed in claim 27 wherein said two non-adjacent panels are said second and fourth side panels and wherein said blank further comprises a fin extension tab adjacent said third bottom fin flap, said fin extension tab being divided from said third bottom fin flap by a wide score line.

30. A blank as claimed in claim 27 wherein said two non-adjacent panels are said first and third side panels and wherein said blank further comprises a fin extension tab adjacent said second bottom fin flap, said fin extension tab being divided from said second bottom fin flap by a wide score line.

31. A blank as claimed in claim 27 wherein said two non-adjacent panels are said first and third side panels and wherein said blank further comprises a fin extension tab adjacent said fourth bottom fin flap, said fin extension tab being divided from said fourth bottom fin flap by a wide score line.

32. A blank as claimed in claim 27 wherein each of the bottom fin flaps is less than half of the length of the adjacent bottom flap.

33. A blank as claimed in claim 27 wherein the maximum of each of said curved score lines occurs proximate the midpoint of the respective curved score line.

34. A blank for forming a carton having a generally flattened gable structure, said blank comprising:

a) first, second, third, and fourth side panels, said first, second, third, and fourth side panels being divided from one another by a plurality of vertical score lines;

b) first, second, third, and fourth flaps respectively adjacent said first, second, third, and fourth side panels, two non-adjacent flaps each including a pair of diagonal score lines that converge at an apex, said flaps being divided from one another by said plurality of vertical score lines;

c) first, second, third, and fourth fin flaps respectively adjacent said first, second, third, and fourth flaps, said fin flaps being divided from one another by said plurality of vertical score lines; and d) a plurality of score lines dividing said fin flaps from said flaps, said plurality of score lines including a wide score line extending between the apices of said two non-adjacent flaps, said wide score line being generally wider than other score lines separating said flaps from said fin flaps.

35. A blank as claimed in claim 34, and further comprising a fin extension tab extending from one of said fin flaps, said fin extension tab engaging said one of said fin flaps at a wide score line to allow said fin extension tab to fold over said fin flaps and contact an exterior surface of another of said flaps for sealing thereto when said blank is folded to form the carton.

36. A blank as claimed in claim 35 wherein said fin extension tab is heat sealed to said another of said flaps when said blank is folded to form the carton.

37. A blank as claimed in claim 34 wherein said two non-adjacent flaps having the pair of diagonal score lines are the second and fourth flaps.

38. A carton as claimed in claim 37 wherein said fin extension tab extends from said first fin flap.

39. A carton as claimed in claim 38 wherein said fin extension tab and said third flap are coated with a thermoplastic material and wherein said fin extension tab is heat sealable to said third flap.

* * * * *

UNITED STATES PATENT AND TRADEMARK OFFICE

CERTIFICATE OF CORRECTION

PATENT NO. : 5,474,232
DATED : December 12, 1995
INVENTOR(S) : Tommy Bo Göran Ljungström et al.

It is certified that error appears in the above-indentified patent and that said Letters Patent is hereby corrected as shown below:

On the title page:

Please include the name of Patrick N. Burkhart in the "Attorney, Agent or Firm" section.

Signed and Sealed this

Twenty-first Day of October 1997

*Attest:*

*Attesting Officer*

BRUCE LEHMAN

*Commissioner of Patents and Trademarks*